United States Patent [19]

Boyer et al.

[11] 4,344,480

[45] Aug. 17, 1982

[54] SUPPORT FOR HEAT EXCHANGE TUBES

[75] Inventors: Robert C. Boyer, Emmaus; George J. Williams, Chalfont, both of Pa.

[73] Assignee: Ecolaire Incorporated, Malvern, Pa.

[21] Appl. No.: 163,543

[22] Filed: Jun. 27, 1980

Related U.S. Application Data

[63] Continuation-in-part of Ser. No. 891,677, Mar. 30, 1978, Pat. No. 4,210,202.

[51] Int. Cl.[3] ..... F28F 1/32

[52] U.S. Cl. ..... 165/162; 248/68 R

[58] Field of Search ..... 165/151-153, 165/162, 168, 170, 176, 178, 171, 183; 248/49, 68 CB, 68 R; 285/188; 138/115, 111

[56] References Cited

U.S. PATENT DOCUMENTS 3,526,934 9/1970 Owen, Sr. ..... 138/111

3,637,008 1/1972 Michel et al. ..... 165/162

4,030,540 6/1977 Roma ..... 165/162

FOREIGN PATENT DOCUMENTS 2727032 12/1977 Fed. Rep. of Germany ..... 165/162

*Primary Examiner*—Samuel Scott

*Assistant Examiner*—Theophil W. Streule, Jr.

*Attorney, Agent, or Firm*—Seidel, Gonda, Goldhammer & Panitch

[57] ABSTRACT

Rows of heat exchange tubes are supported by transversely disposed support strips having a plurality of U-shaped members interconnected end to end in a manner so that said strips act as a structural member supporting the weight of the tubes and additional support elements from all rows above a given row. Each leg of each U-shaped member converges upwardly or downwardly at an angle of about 8° to 15° with the vertical.

5 Claims, 12 Drawing Figures

FIG. 5
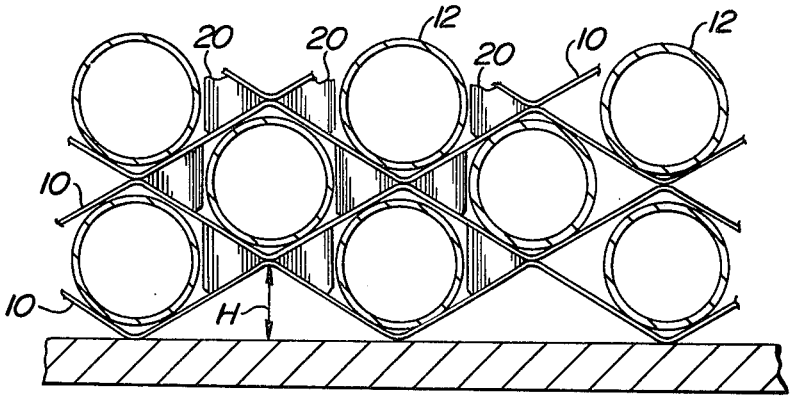
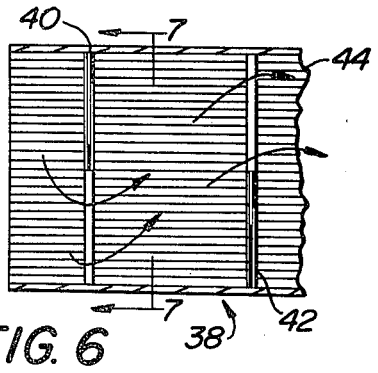
FIG. 6
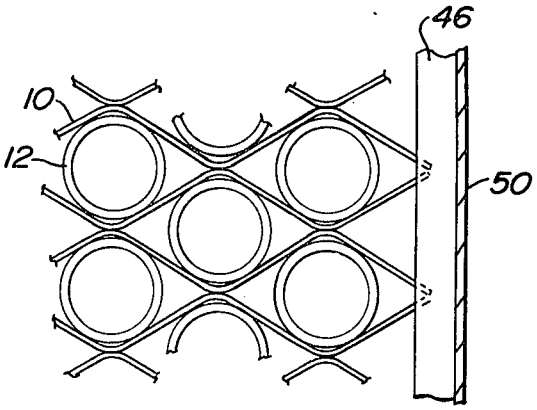
FIG. 9

SUPPORT FOR HEAT EXCHANGE TUBES

RELATED CASE

This application is a continuation-in-part of our pending application Ser. No. 891,677 filed Mar. 30, 1978 and now U.S. Pat. No. 4,210,202 granted July 1, 1980.

BACKGROUND

In a conventional heat exchanger such as a condensor, horizontal rows of tubes are supported at spaced points along the length of the tubes by support plates. A typical support plate is ¾ inch thick. The support plates must be drilled to provide the holes through which the tubes will extend. Each tube must be guided through its hole in the support plate. Hence, the support plate envelops a band ¾ inch long around the entire periphery of each tube in a manner whereby such band is unavailable for acting as a condensing or heat exchange surface. Each condenser or heat exchanger has a substantial number of such support plates at spaced points along the length of the tubes.

Because of the cost and time consuming effort involved in the use of a conventional support plate as the primary structural member, the present invention is directed to elimination of the conventional support plate.

SUMMARY OF THE INVENTION

One aspect of the present invention is an article of manufacture in the form of a tube support strip of sheet metal having a plurality of U-shaped members interconnected end to end. Each leg of each U-shaped member may have a generally triangular tab bendable out of the plane of its associated leg.

Another aspect of the present invention is a tube bundle wherein a first row of tubes is supported by a first tube support strip as set forth above and a second row of tubes is supported by a second tube support strip as set forth above. The first support strip supports the second support strip so as to define a structural member supporting the weight of the tubes and wherein each support strip has line contact with each tube at two locations.

In addition to the advantages resulting from the elimination of conventional support plates in accordance with the present invention, a plurality of other advantages and unexpected results have been attained. Thus, the present invention significantly reduces welding operations, facilitates practical application of automated method of assembling rows of tubes, eliminates tube handling damage, reduces field assembly time, increases tube surface area available for heat transfer, increases the area available for tubing, provides a control for the flow of shell side effluent along the length of the tubes, etc.

It is an object of the present invention to provide a heat exchanger such as a condenser wherein conventional support plates are eliminated while at the same time providing a structural support for the weight of the tubes so that the tubes in a bottom row do not support the weight of the tubes in the rows thereabove.

Other objects will appear hereinafter.

For the purpose of illustrating the invention, there is shown in the drawings a form which is presently preferred; it being understood, however, that this invention is not limited to the precise arrangements and instrumentalities shown.

FIG. 5 is a sectional view taken along the line 5—5 in FIG. 4.

FIG. 6 is a partial plan view of a heater constructed in accordance with the present invention.

FIG. 9 is a sectional view of a heat exchanger in accordance with FIG. 8.

Figure 3:
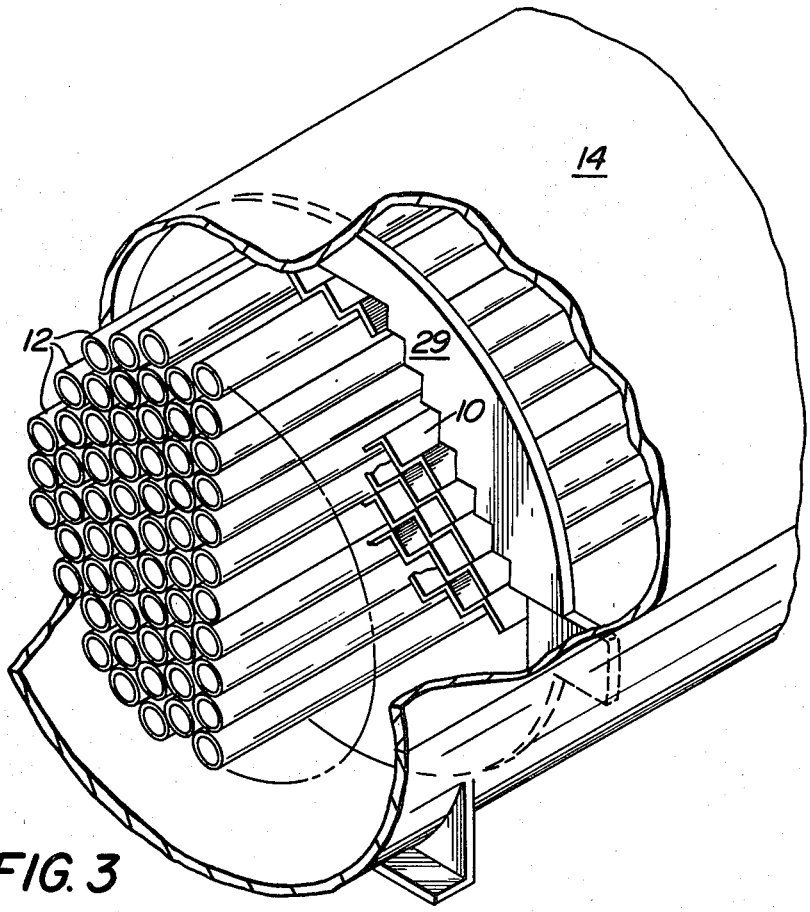
FIG. 3 is a partial perspective view of a heat exchanger such as a condenser constructed in accordance with the present invention.

Referring to the drawings in detail, wherein like numerals indicate like elements, there is shown a pair of mating tube support strips in accordance with the present invention each designated generally as 10. The support strips 10 are identical except for length. The support strips 10 are adapted to support rows of tubes 12 disposed within a shell 14. See FIG. 3.

Figure 1:
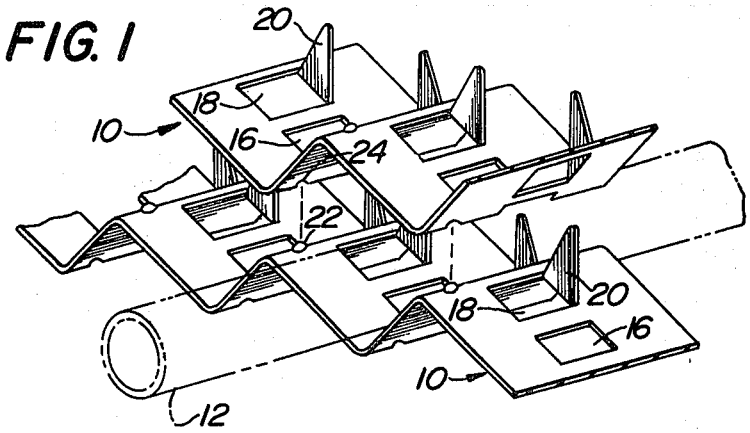
FIG. 1 is a perspective view of a portion of a pair of mating support strips in accordance with the present invention.

Referring to FIG. 1, the tube support strips 10 are a strip of sheet metal such as stainless steel having a plurality of V-shaped members interconnected end to end. Each leg of each V-shaped member has a first hole 16 extending therethrough and a second hole 18 extending therethrough. The holes 16 are closer to the lower apex and the holes 18 are closer to the upper apex. There is provided a tab 20 associated with each of the holes 18. Each tap 20 is generally triangular shaped with its base being integral in one piece with its associated leg. Each tab 20 is adapted to be bent out of the plane of its associated leg.

Each of the support strips 10 is of the same length when used to support tubes of a heat exchanger such as a condenser which is rectangular. If the condenser is circular in cross-section, each strip 10 has a length which is slightly different from the length of the next adjacent strip. Each strip has a width which is between 1 and 2 times the diameter of the tubes 12 to be supported thereby. Stated differently, each of the strips has a width which is about 1 to 5 times its height. The height of the strips is designated by the arrow H in FIG. 5. The gauge of the material of strip 10 will vary with the size of the heat exchanger and will be of greater gauge as the size of the heat exchanger increases with the controlling factor being that the support strips cooperate with one another to serve as a structural support member for supporting the weight of the tubes thereabove. Since the lower tubes will not be supporting the weight of the tubes thereabove, removal and/or replacement of a lower tube is easily facilitated.

At spaced points along the length of the tubes, the support strips will be superimposed over one another with a row of tubes between each support strip. The linear distance between the locations where the tubes are supported by the support strips is preferably calculated in a manner well known to those skilled in the art so as to minimize vibrations in the tubes.

The support strips are preferably interlocated with the next adjacent support strip so as to preclude sidewise shifting of one support strip with respect to another. Such interlock is preferably attained at the location wherein one support strip contacts the next adjacent support strip, namely at the apexes. Thus, each upper apex is provided with a protrusion 22 and each lower apex is provided with a mating recess designated 24. See FIG. 1.

Figure 2:
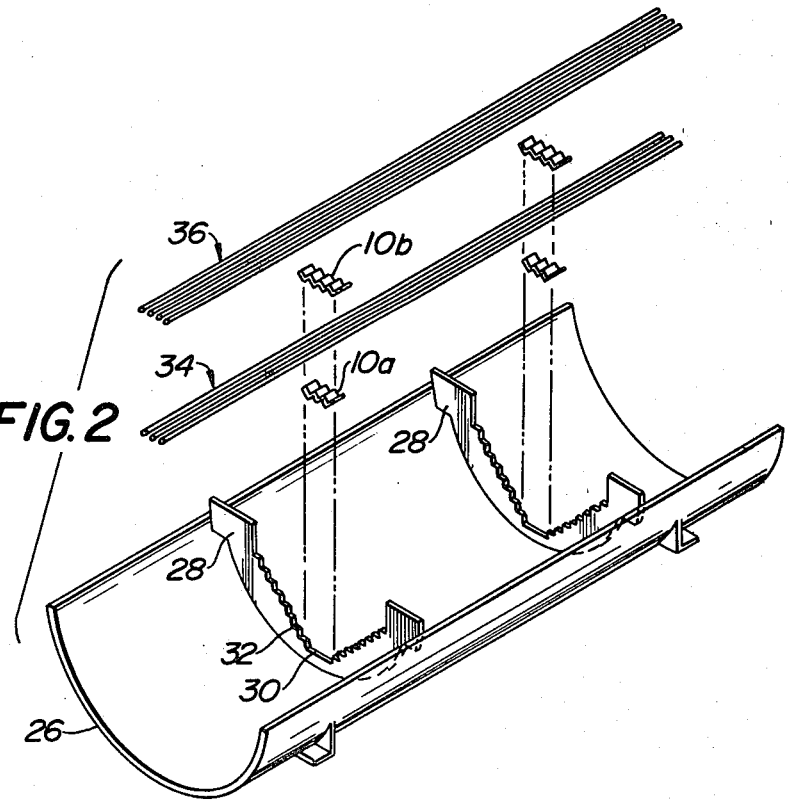
FIG. 2 is a partial exploded view of a shell half, two support strips and two rows of tubes.

Referring to FIG. 2, there is shown the lower shell half 26 of a cylindrical condenser. At spaced points along the length of the shell half 26, there are provided lower support frames 28. An upper support frame 29 will be provided for each of the frames 28 as shown more clearly in FIG. 3. The support frames 20 are identical. Hence, only one such support frame 28 will be described in detail.

The support frame 28 is generally semi-circular with a plurality of steps on its uppermost surface. The largest step is designated 30 and is in the middle of the frame 28 so as to be directly below the longitudinal axis of the shell half 26. The remaining steps designated 32 are shorter in length than the length of step 30. A first support strip 10*a* is provided having a length corresponding to the length of step 30. With a support strip 10*a* on each of the steps 30, a first row 34 of tubes 12 are placed over the support strips 10*a*. It will be noted that the number of tubes in row 34 corresponds to the number of V-shaped recesses on the upper surface of strip 10*a*.

Thereafter, a support strip 10″ is placed over the row 34 at each of the locations of step 32 on the frames 28. The protrusions 22 on the strip 10*a* interlock with the recesses 24 on the strip 10*b*. The number of V-shaped recesses on the upper surface of strips 10*b* corresponds to the number of tubes 12 in row 36. The sequence is then repeated using correspondingly increased lengths of strips 10 and a larger number of tubes 12 in the various rows.

Figure 4:
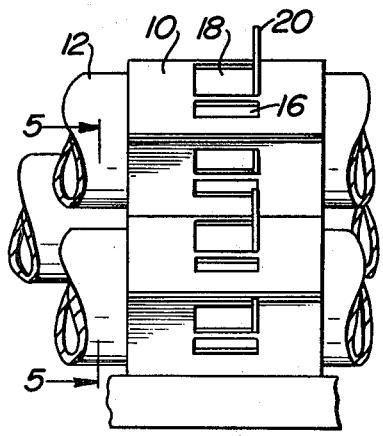
FIG. 4 is a partial side elevation view of a tube bundle showing the relative length of the tube support strips with respect to the diameter of the tubes.

Each of the strips engage the tubes juxtaposed thereto with line contact at two locations on the tubes 12. As will be apparent from FIG. 5, the height H of the V-shaped support strips is slightly greater than $\frac{1}{2}$ the diameter of the tubes 12 so that the respective support strips cooperate with one another to provide a structural support for the weight of the tubes thereabove. As shown in FIG. 4, the width of the strips 10 is between 1 and 2 times the diameter of the tubes 12.

Figure 7:
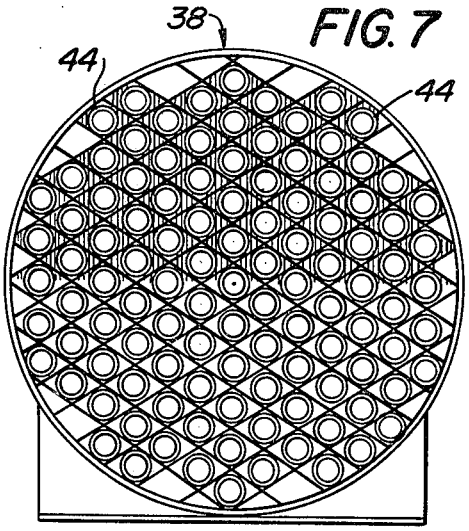
FIG. 7 is a sectional view taken along the line 7—7 in FIG. 6.

In FIG. 6, there is illustrated a heater 38 having a cylindrical shell with a plurality of tubes 44 supported by strips 10, 10*a*, 10*b*, as described above. The direction of flow within the shell and exteriorly of the tubes 44 is designated by the curved arrows in FIG. 6 and attained by staggered barriers 40, 42, etc. The barriers 40 and 42 are attained by bending the tabs 20 upwardly on one side of the shell and permitting the tabs 20 on the other side of the shell to remain in the plane of their respective legs. See FIGS. 5 and 7 wherein some of the tabs 20 are bent upwardly while others remain in the plane of their leg. Thus, the present invention provides an unexpected benefit in being able to control longitudinal flow on the shell side in connection with cascading-flow heat exchangers such as a feed water heater.

Figure 8:
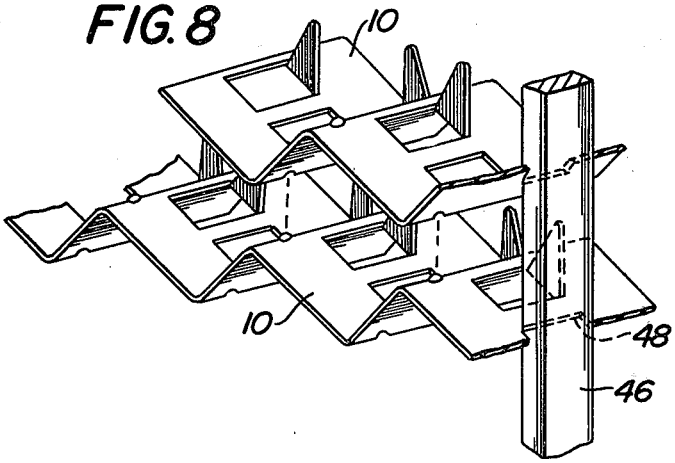
FIG. 8 is a partial perspective view of support strips in accordance with the present invention showing the interlock of the ends with a support frame when constructing a rectangular heat exchanger.

Referring to FIGS. 8 and 9, the present invention is adaptable for use with heat exchangers that are rectangular in cross-section. In a rectangular shell 50, there will be provided vertically disposed frame members 46 at spaced points therealong in the same manner that frames 28 were provided as described above. All, or substantially all, of the support strips 10 will be of the same length and will have notches 48 at their ends for receiving the frame members 46. Notch 48 is attached by cutting across a hole 16. The cooperation between frame 46 and notches 48 automatically prealigns the support strips 10 so that each protrusion 22 will be juxtaposed to a recess 24 on the next adjacent support strip. As shown in FIG. 9, the vertical height between the support strips corresponds to the diameter of the tubes 12 so that each tube has line contact with a support strip at four different locations.

Figure 10:
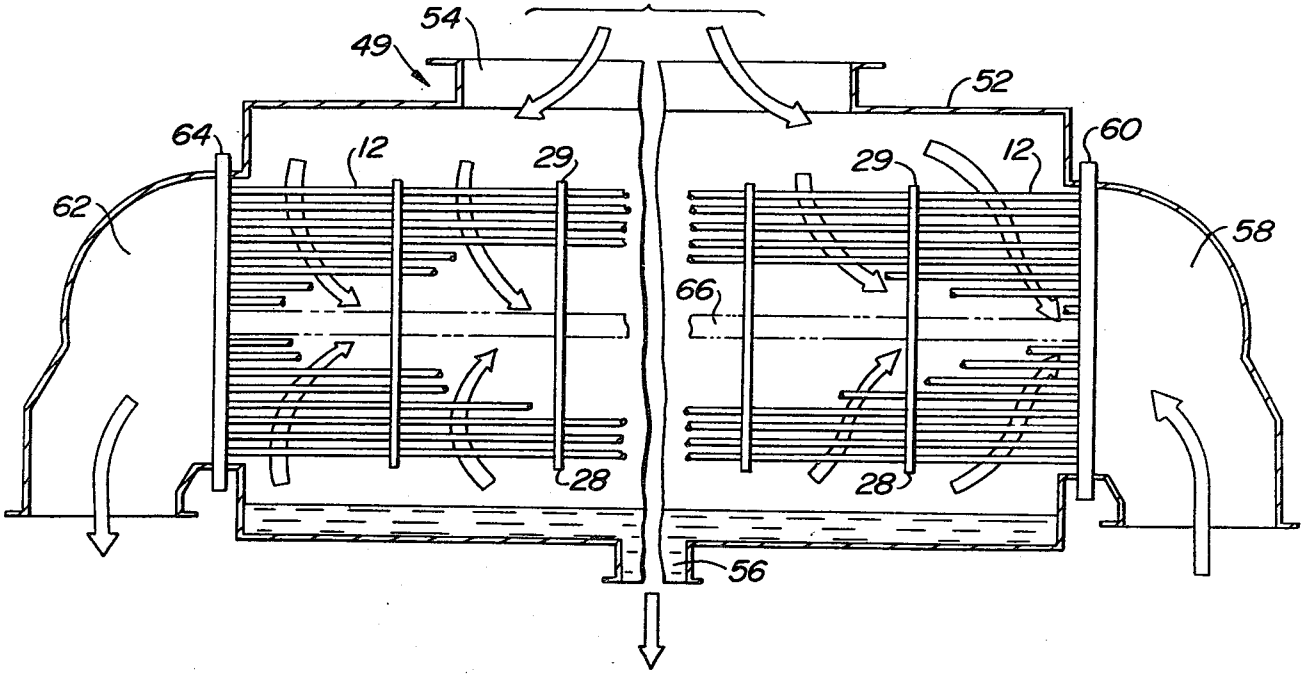
FIG. 10 is a diagrammatic longitudinal sectional view of a condenser constructed in accordance with the present invention.

Referring to FIG. 10, there is diagrammically illustrated a typical surface condenser 49. The condenser 49 includes a shell 52 having a vapor inlet 54 and a condensate outlet 56. A coolant inlet 58 is connected to a tube sheet at one end of the shell 52. A coolant outlet 62 is connected to a tube sheet 64 at the other end of the shell 52. The tubes 12 are supported at their ends and are sealed to the tube sheets 60, 64.

As shown in FIG. 10, the tube bundle defined by the tubes 12 and their frames 28, 29 is constructed as set forth above with support strips between the various rows of tubes. The frames 28, 29 retain the tube bundle in an assembled relationship prior to securing the ends of the tubes 12 to the tube sheets 60, 64.

A unique feature of the present invention lies in the ability to control the flow of the shell side effluent along the lengths of the tubes. Such flow is in a direction reverse to the direction of flow through the tubes 12. As illustrated in FIG. 10, the proper orientation of a surface condenser requires that the major outermost portion of the bundle is constructed such that longitudinal flow is retarded thereby forcing the shell side effluent (typically steam) to penetrate into the center of the bundle toward the cooler zone designated 66 in each section of the bundle between the frames 28, 29. This penetration assures optimum effectiveness of the total surface area of the tubes and tends to form a collection area for the non-condensable vapors. In the cooler zone 66, longitudinal flow of vapors is promoted by permitting the tabs 20 to remain in the plane of the leg of their V-shaped member while bending the tabs 20 to a position perpendicular to their associated leg in the outer peripheral portions of the tube bundle.

As shown in FIG. 10 and described above, longitudinal flow is promoted such that non-condensable vapor (such as air) is directed toward a terminal collection point adjacent tube sheet 60. A terminal collection point is sometimes called a terminal cooler. Since the retardation and promotion of longitudinal flow is controlled by the simple manipulation of the position of the tabs 20, significant advantages are realized. For example, the more conventional cooler required that a certain region not contain or be devoid of tubes. This region required openings in the conventional support plate for the required longitudinal flow of non-condensable vapors. Some structural hardware was required to act as baffles and force the non-condensable vapors to contact tubes in its path to the terminal cooler so that any entrained condensable vapor that remained may be condensed. Such longitudinal flow is now easily promoted using the present invention whereby the previously untubed region can now be fully tubed allowing for a more efficient design.

The present invention whether in the form of a tube support structure, a tube bundle incorporating such support strips, or in a heat exchanger such as a condenser incorporating such tube bundle, provides for a multiplicity of advantages and unexpected results. As used herein, the word "fluid" is used on a broad sense so as to cover liquids and gases. The tube support strips while maintaining the spacing between tubes of the same row and tubes of adjacent rows provides for maximum heat exchanger efficiency since a larger surface of the tubes is exposed to the shell side effluent. In addition, the tube support strips serve as a structural member supporting the weight of the tubes and the support elements from all rows above a given row. There is a tendency for the tube support strip to act as a fin for promoting conductive heat transfer between the tube and the tube support element and convective heat transfer to the shell side effluent.

The conventional method of drilling holes in support plates and inserting tubes through such holes is difficult, time consuming, and expensive. The present invention eliminates the use of drilled tube support plates. As a result thereof, it is now practical to automate the dispensing of tubes and the assembly of a heat exchanger such as a condenser. Tube support strips are placed in a shell, and then a row of tubes is dropped onto the tube support strips. The process is repeated thereby substantially increasing production capability and reducing manufacturing costs. The present invention has advantages in reducing field assembly time which is of particular importance on large surface condensers which typically serves steam turbines of a nuclear fuel power plant or the like. Thus, the present invention lends itself to assembling the condenser at the job site as well as permitting preassembly of the tube bundle in the factory for shipment to the job site.

Figure 11:
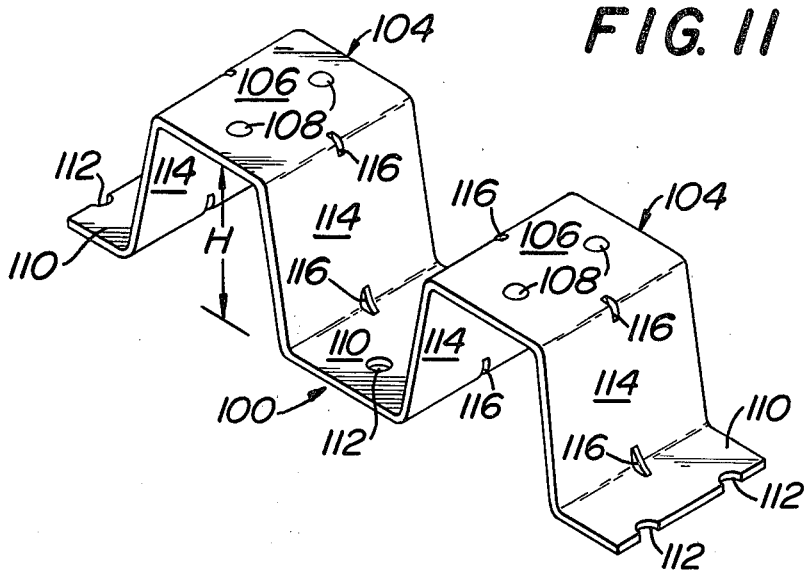
FIG. 11 is a partial perspective view of another embodiment of a support strip.

In FIG. 11 there is illustrated a tube support strip 100 which is identical with strip 10 except as will be made clear hereinafter. Strip 100 is designed for use with tubes 102 arranged in a square pitch pattern.

Strip 100 has a plurality of U-shaped members 104 of sinusoidal form with each upper bight 106 having at least one and preferably a pair of protrusions 108 and each lower bight 110 having a mating set of holes 112. Each hole 112 on one strip 100 is adopted to receive a protrusion 108 on an adjacent strip 100 to interlock the strips. Each leg 114 of each member 104 is planar and converges toward its associated bight at an acute angle of about 8° to 15° from the vertical whereby each tube 102 is in line contact with and supported by a pair of legs 114 herebelow.

Figure 12:
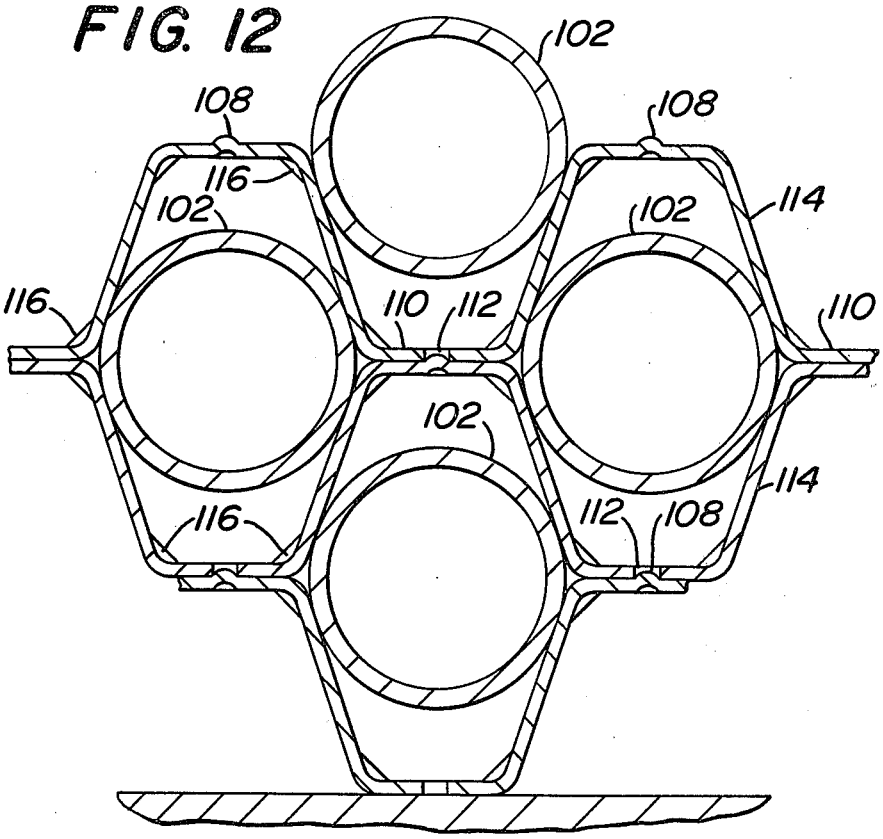
FIG. 12 is a sectional view through a tube bundle, similar to FIG. 5, but showing the support strip of FIG. 11.

As shown in FIG. 12 the tubes 102 are arranged in a square pitch pattern. That is, the axes of four tubes 102 form a square. Each strip 100 is interlocked with the strip thereabove so that members 104 form openings which are non-regular hexagons with the converging legs being longer than the bights. The strips 100 form a rigid support structure for supporting the weight of the tubes 102 thereabove. The lower tubes 102 do not support the weight of tubes 102 thereabove as described above in connection with strips 10.

An indentation 116 is provided at the intersection of each leg 114 and each bight 110 along the centerline of the strips for reinforcement. A typical indention is 0.050 inches. The width of the strips 100 is preferably between 1 and 2 times the height H. If strip 100 is one inch wide, a preferred dimension for height H is 0.61 inches.

For the purpose of illustrating the invention, there is shown in the drawings a form which is presently preferred; it being understood, however, that this invention is not limited to the precise arrangements and instrumentalities shown.

The present invention may be embodied in other specific forms without departing from the spirit or essential attributes thereof and, accordingly, reference should be made to the appended claims, rather than to the foregoing specification as indicating the scope of the invention.

We claim:

1. In a heat exchanger tube bundle assembly having a plurality of juxtaposed horizontally disposed tubes which comprises at least two sinusoidal tube support strips each having a plurality of members interconnected end to end, releasable interlock means on a plurality of said members to facilitate interlocking said strips with another in a manner so that a plurality of openings are provided therebetween for accommodating said horizontally disposed heat exchange tubes, said means including a plurality of projections on one strip and mating holes on an adjacent strip, each projection being integral in one piece with its associated strip, the improvement comprising said members being U-shaped so as to define a square pitch pattern of non-regular hexagon shaped openings whose converging sides are longer than horizontally disposed bights, said projections and holes being on the bights.

2. The support strips in accordance with claim 1 including a reinforcing indentation along the centerline of each strip at the intersection of each leg and bight.

3. The support strips in accordance with claim 1 wherein each bight has two projections or two holes on opposite sides of the centerline of the strip.

4. The support strips in accordance with claim 1 wherein each converging leg is at an angle of 8° to 15° with respect to the vertical.

5. In a heat exchange tube bundle assembly having a plurality of juxtaposed horizontally disposed tubes which comprises at least two sinusoidal tube support strips each having a plurality of members interconnected end to end, releasable interlock means on a plurality of said members to facilitate interlocking said strips with another in a manner so that a plurality of openings are provided therebetween for accommodating said horizontally disposed heat exchange tubes, said means including a plurality of projections on one strip and mating holes on an adjacent strip, each projection being integral in one piece with its associated strip, the improvement comprising said members being U-shaped so as to define a square pitch pattern of non-regular hexagon shaped openings whose converging sides are longer than horizontally disposed bights, said projections and holes being on the bights, each converging leg being at an acute angle of between 8° and 15° with respect to the vertical, and a reinforcing indentation at the intersection of each leg and bight.

* * * * *